US012180980B2

(12) United States Patent
He et al.

(10) Patent No.: US 12,180,980 B2
(45) Date of Patent: Dec. 31, 2024

(54) FLUID PUMP HEALTH PROTECTION

(71) Applicant: Caterpillar Inc., Peoria, IL (US)

(72) Inventors: Yuesheng He, Sugar Land, TX (US); Andy Publes, Katy, TX (US); Mark C. Paul, Carmel, IN (US); Mark Francis Grimes, Cypress, TX (US)

(73) Assignee: Caterpillar Inc., Peoria, IL (US)

( * ) Notice: Subject to any disclaimer, the term of this patent is extended or adjusted under 35 U.S.C. 154(b) by 183 days.

(21) Appl. No.: 17/819,778

(22) Filed: Aug. 15, 2022

(65) Prior Publication Data

US 2024/0052826 A1 Feb. 15, 2024

(51) Int. Cl.
*F04D 29/66* (2006.01)

(52) U.S. Cl.
CPC ..... *F04D 29/669* (2013.01)

(58) Field of Classification Search
CPC .... F04D 29/66–29/669; F04D 15/0263; F04C 16/0046; F04C 29/028; F04B 43/009; F04B 2201/0208; F04B 2201/0405; F04B 2201/0605; F04B 2201/0803; F04B 51/00; F04B 2203/0207; F04B 2203/0209; F04B 2203/0409; F04B 53/143; F04B 49/20; F04B 11/00; F04B 11/041

See application file for complete search history.

(56) References Cited

U.S. PATENT DOCUMENTS

| | | | | |
|---|---|---|---|---|
| 2,774,257 | A * | 12/1956 | Tyler | F16H 61/02 475/116 |
| 9,341,055 | B2 | 5/2016 | Weightman et al. | |
| 9,777,723 | B2 | 10/2017 | Wiegman et al. | |
| 9,920,615 | B2 | 3/2018 | Zhang et al. | |
| 10,385,841 | B2 * | 8/2019 | Zhang | F04B 17/05 |
| 10,711,787 | B1 * | 7/2020 | Darley | F04D 29/4293 |
| 10,844,854 | B2 | 11/2020 | Zhang et al. | |
| 2002/0141891 | A1 * | 10/2002 | Gunderson | F04B 53/162 417/555.1 |
| 2005/0022589 | A1 * | 2/2005 | Du | F15B 19/005 702/114 |
| 2008/0076635 | A1 * | 3/2008 | Lee | F16H 61/143 477/180 |
| 2010/0269574 | A1 * | 10/2010 | Zeqiri | G01N 29/42 73/61.79 |
| 2010/0300683 | A1 | 12/2010 | Looper et al. | |
| 2011/0214919 | A1 * | 9/2011 | McClung, III | E21B 3/022 175/57 |
| 2014/0044561 | A1 * | 2/2014 | Leiber | F04B 49/20 417/20 |

(Continued)

*Primary Examiner* — Philip E Stimpert
*Assistant Examiner* — Dnyanesh G Kasture

(57) ABSTRACT

In some implementations, a controller may monitor, in connection with a fluid pump driven by a motor that is controlled by a variable frequency drive and over a time period, a torque of the motor to obtain torque data, a speed of the motor to obtain speed data, and a pressure of the fluid pump to obtain pressure data. The controller may determine that the fluid pump is associated with a leak of a particular severity level based on the torque data indicating a deviation that satisfies a first threshold, the speed data indicating a deviation that satisfies a second threshold, and the pressure data indicating a deviation that satisfies a third threshold. The controller may perform at least one operation based on the particular severity level of the leak.

19 Claims, 5 Drawing Sheets

(56) References Cited

U.S. PATENT DOCUMENTS

| | | | | |
|---|---|---|---|---|
| 2015/0377318 | A1* | 12/2015 | Byrne | F16D 37/008 700/282 |
| 2016/0168953 | A1* | 6/2016 | Zhang | G01M 99/00 702/35 |
| 2018/0040226 | A1* | 2/2018 | Zhang | F04B 53/14 |
| 2018/0209415 | A1* | 7/2018 | Zhang | F04B 17/05 |
| 2019/0145392 | A1* | 5/2019 | Brown | F04B 23/021 417/379 |
| 2019/0312537 | A1* | 10/2019 | Samuel | H03K 17/689 |
| 2020/0370988 | A1* | 11/2020 | Rogers | F04B 15/02 |
| 2022/0341543 | A1* | 10/2022 | Kreutzkaemper | F16N 13/16 |
| 2022/0403723 | A1* | 12/2022 | Yeung | B01F 23/581 |

* cited by examiner

| | a | b | c | d | e | f | ... |
|---|---|---|---|---|---|---|---|
| Intake (PSI) | 70 | 70 | 70 | 70 | 70 | 70 | ... |
| Discharge ($1e^3$ PSI) | 10 | 10 | 10 | 10 | 10 | 10 | ... |
| Air % | 0.1 | 0.1 | 0.1 | 0.1 | 0.1 | 0.1 | ... |
| Proppant % | 0 | 10 | 20 | 30 | 40 | 50 | ... |
| Cavitation occurs at... (RPM) | 150 | 160 | 165 | 170 | 180 | 190 | ... |

FLUID PUMP HEALTH PROTECTION

TECHNICAL FIELD

The present disclosure relates generally to fluid pumps and, for example, to fluid pump health protection.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

During hydraulic fracturing operations, a pump of a hydraulic fracturing system may have a reduced output or may fail, for example, due to a leak or cavitation. Typically, such failure states may go undetected until visible indications, such as a visible leak, are present. As a result, excessive wear or damage to the pump or other components of the hydraulic fracturing system may occur.

The control system of the present disclosure solves one or more of the problems set forth above and/or other problems in the art.

SUMMARY

In some implementations, a system for hydraulic fracturing includes a fluid pump; a motor configured to drive the fluid pump; a variable frequency drive (VFD) configured to control the motor; and a controller. The controller may be configured to monitor, over a time period, a torque of the motor to obtain torque data, a speed of the motor to obtain speed data, and a pressure of the fluid pump to obtain pressure data. The controller may be configured to determine that the fluid pump is associated with a leak of a particular severity level based on the torque data indicating a deviation that satisfies a first threshold, the speed data indicating a deviation that satisfies a second threshold, and the pressure data indicating a deviation that satisfies a third threshold. The controller may be configured to cause, via the VFD, reduction of the speed of the motor based on the particular severity level of the leak.

In some implementations, a method includes monitoring, in connection with a fluid pump driven by a motor that is controlled by a VFD and over a time period, a torque of the motor to obtain torque data, a speed of the motor to obtain speed data, and a pressure of the fluid pump to obtain pressure data. The method may include determining that the fluid pump is associated with a leak of a particular severity level based on the torque data indicating a deviation that satisfies a first threshold, the speed data indicating a deviation that satisfies a second threshold, and the pressure data indicating a deviation that satisfies a third threshold. The method may include performing at least one operation based on the particular severity level of the leak.

In some implementations, a controller includes one or more memories, and one or more processors communicatively coupled to the one or more memories. The one or more processors may be configured to monitor, in connection with a fluid pump driven by a motor that is controlled by a VFD and over a time period, at least one of a torque of the motor to obtain torque data, a speed of the motor to obtain speed data, or a pressure of the fluid pump to obtain pressure data. The one or more processors may be configured to determine whether the fluid pump is associated with a leak of a particular severity level based on at least one of the torque data indicating a deviation that satisfies a first threshold, the speed data indicating a deviation that satisfies a second threshold, or the pressure data indicating a deviation that satisfies a third threshold. The one or more processors may be configured to determine, with reference to a table indicating sets of operating parameter values associated with cavitation, a cavitation level associated with operating parameters for the fluid pump and the motor, the cavitation level indicating a probability that cavitation is to occur. The one or more processors may be configured to cause, via the VFD, reduction of the speed of the motor based on at least one of the particular severity level of the leak or the cavitation level.

DETAILED DESCRIPTION

Figure 1:
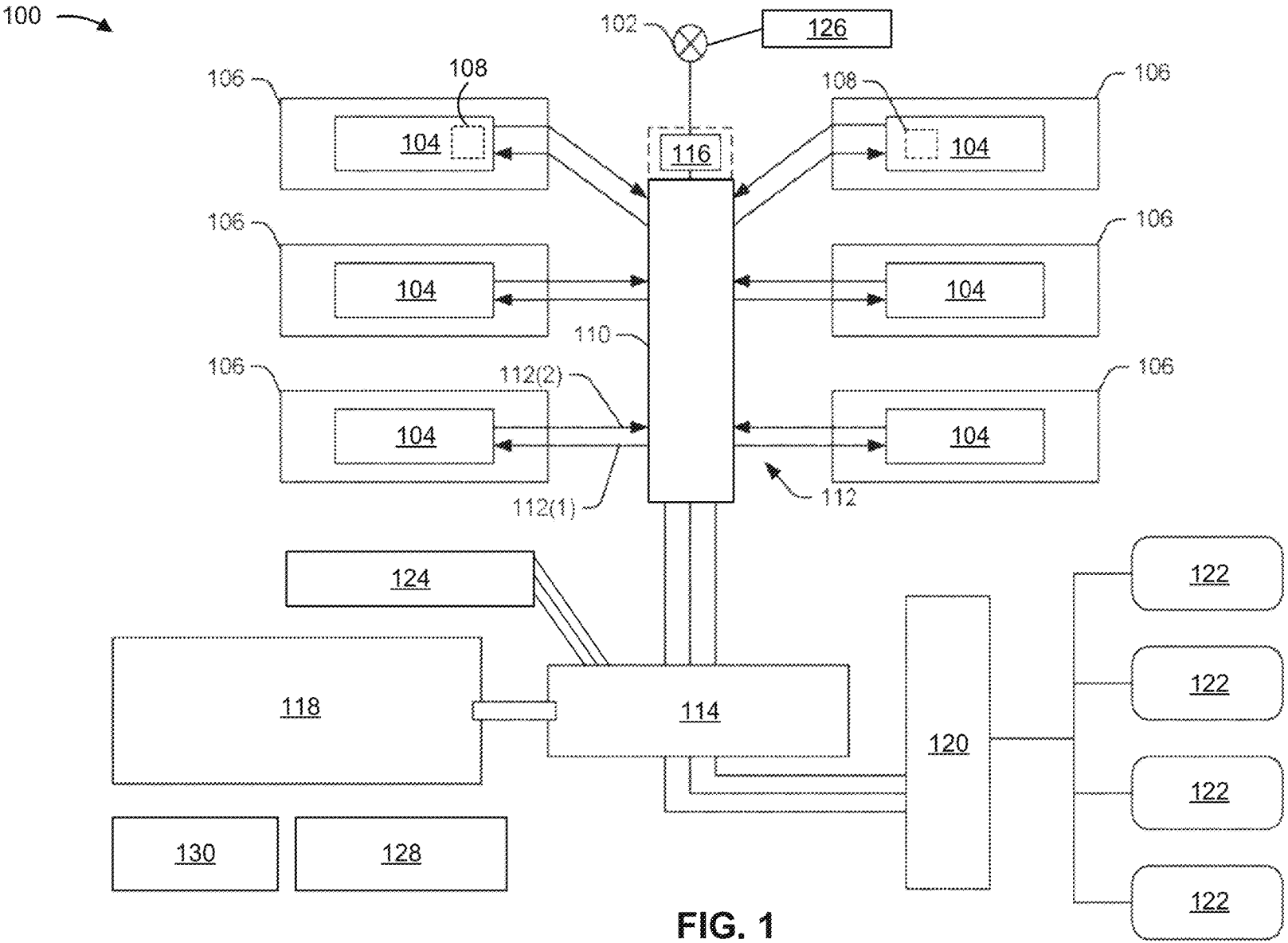
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described above, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with monitoring the health of a fluid pump, as described in connection with FIG. 2.

As indicated above, FIG. 1 is provided as an example. Other examples may differ from what is described with regard to FIG. 1.

Figure 2:
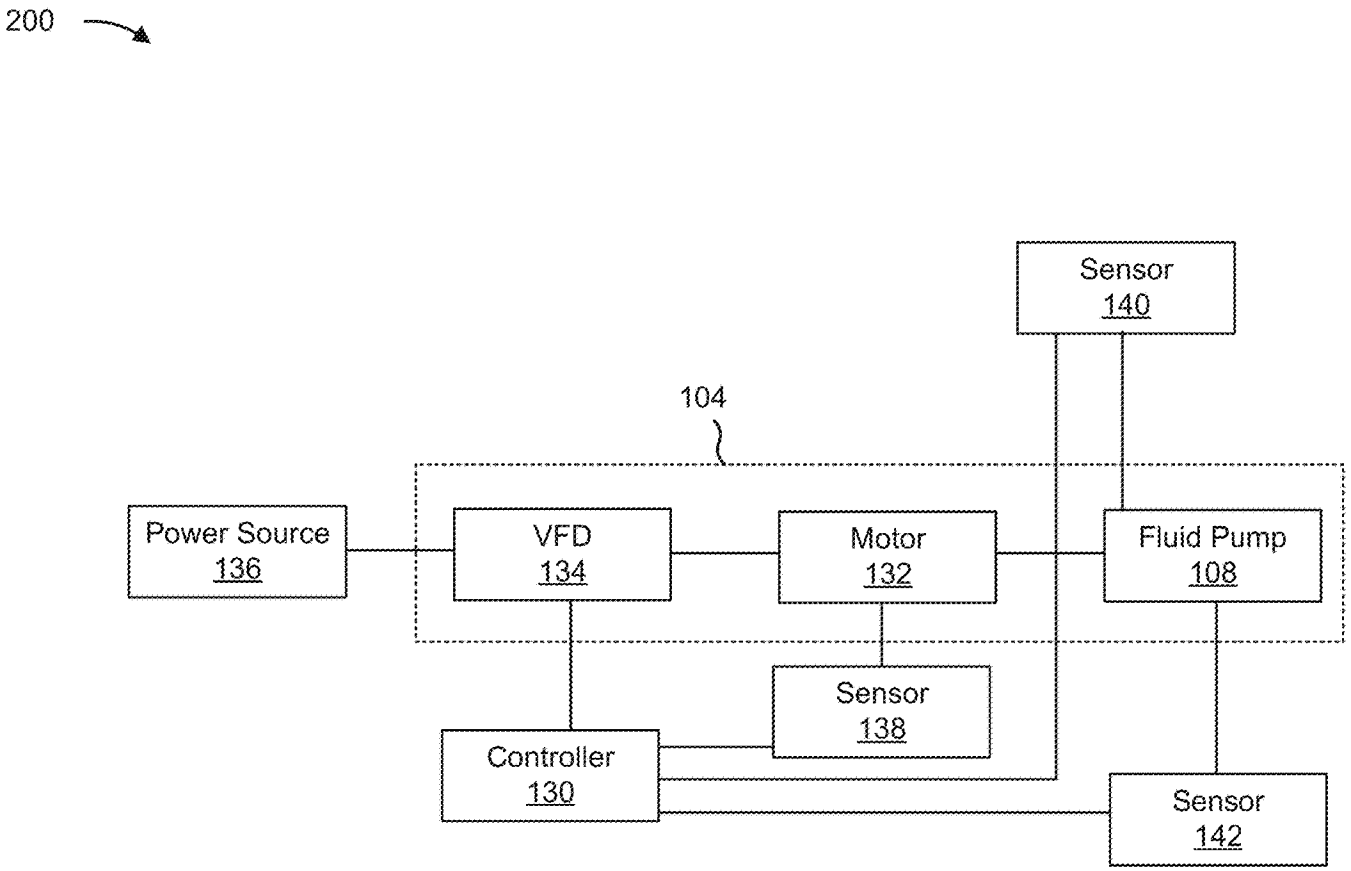
FIG. 2 is a diagram illustrating an example control system.

FIG. 2 is a diagram illustrating an example control system 200. The control system 200 may include one or more components of the hydraulic fracturing system 100, as described herein.

As shown in FIG. 2, the control system 200 includes a pump system 104, and the pump system 104 includes a fluid pump 108, as described herein. The pump system 104 also includes a motor 132 configured to drive (e.g., via a driveshaft) the fluid pump 108. The motor 132 may include an electric motor (e.g., an alternating current (AC) electric motor), such as an induction motor or a switched reluctance motor. In some examples, the fluid pump 108 and the motor 132 may share a housing. The pump system 104 also includes a variable frequency drive (VFD) 134 that controls the motor 132. For example, the VFD 134 includes an electro-mechanical drive system configured to control a speed and/or a torque of the motor 132 by varying an input frequency and/or input voltage to the motor 132. In contrast to a conventional mechanical pump system, the motor 132 and/or the VFD 134 may be configured to provide real-time driveshaft torque and motor speed feedback. The pump system 104 (e.g., the VFD 134) may receive electrical power from a power source 136. For example, the power source 136 may be a generator, a generator set, a battery, one or more solar panels, an electrical utility grid, an electrical microgrid, or the like.

As shown in FIG. 2, the control system 200 includes the controller 130. The controller 130 may be configured to perform operations associated with monitoring the health of the fluid pump 108, such as operations associated with detecting a leak or cavitation of the fluid pump 108. The controller 130 may be a component of the VFD 134, or the controller 130 may be a component separate from the VFD 134. For example, the controller 130 may be a pump-specific controller for the pump system 104, or the controller 130 may be a system-wide controller for the hydraulic fracturing system 100. The controller 130 may initiate operations associated with monitoring the health of the fluid pump 108, described herein, responsive to an operator command, based on a health monitoring feature being enabled for the hydraulic fracturing system 100, periodically, or the like.

The controller 130 may be provisioned with (e.g., the controller may store) information used for detecting a leak of the fluid pump 108 and/or cavitation of the fluid pump. In some implementations, the information may include reference data representing normal operation of the fluid pump 108 (e.g., when the fluid pump 108 is not associated with a leak). The reference data may include reference pressure data (e.g., time domain or frequency domain pressure data indicating an intake pressure and/or a discharge pressure associated with normal operation), reference torque data (e.g., time domain or frequency domain torque data indicating a torque associated with normal operation), and/or reference speed data (e.g., time domain or frequency domain pressure data indicating a speed associated with normal operation).

In some implementations, the information may include a table indicating sets of operating parameter values associated with cavitation. For example, the operating parameters may include a pump intake pressure, a pump discharge pressure, an air percentage in water of a fracking fluid, a proppant (e.g., sand) percentage of the fracking fluid, and/or a motor speed (e.g., in revolutions per minute (RPM)). As an example, the table may indicate that at a first combination of values for pump intake pressure, pump discharge pressure, air percentage, and proppant percentage, cavitation occurs at a first motor speed, and for a second combination of values for pump intake pressure, pump discharge pressure, air percentage, and proppant percentage, cavitation occurs at a second motor speed. The controller 130, or another device, may determine the values for the table using a pump model (e.g., a high-fidelity pump model), and based on an assumption that cavitation occurs when a minimum pressure in a pump chamber is 0 psi.

The control system 200 may include one or more sensors 138, 140, 142 in communication with the controller 130. The sensor 138 may include one or more devices configured to detect a torque and/or a speed at the driveshaft of the motor 132. The sensor 138 may be located at the driveshaft of the motor 132. The sensor 140 may include one or more devices configured to detect an intake pressure of the fluid pump 108. The sensor 140 may be located at an inlet of the fluid pump 108, in a fluid conduit in fluid communication with the inlet of the fluid pump 108, or the like. The sensor 142 may include one or more devices configured to detect a discharge pressure of the fluid pump 108. The sensor 142 may be located at an outlet of the fluid pump 108, in a fluid conduit in fluid communication with the outlet of the fluid pump 108, in the manifold 110, or the like.

The controller 130 may obtain measurements of a torque of the motor 132 (e.g., a torque on the driveshaft of the motor 132) and/or a speed of the motor 132 (e.g., a speed of the driveshaft of the motor 132). For example, the controller 130 may obtain the measurements of the torque and/or the speed using the sensor 138. Additionally, or alternatively, the controller 130 may determine (e.g., estimate) a torque of the motor 132 (e.g., a torque on the driveshaft of the motor 132) and/or a speed of the motor 132 (e.g., a speed of the driveshaft of the motor 132). For example, the controller 130 may estimate the torque and/or the speed based on a magnetic flux of the motor 132, a current of an armature of the motor 132, and/or a signal of the VFD 134. As an example, the torque may be indicated by the current of the motor 132 (e.g., data out of the VFD 134 may be identical for torque and current at all operating conditions of the fluid pump 108). Accordingly, torque and motor current may be used interchangeably in the description herein. That is, descriptions herein relating to torque are equally applicable to motor current.

The controller 130 may obtain measurements of an intake pressure (e.g., a suction pressure, an inlet pressure, a low pressure, or the like) of the fluid pump 108. For example, the controller 130 may obtain the measurements of the intake pressure using the sensor 140. The controller 130 may obtain measurements of a discharge pressure (e.g., an outlet pressure, a high pressure, or the like) of the fluid pump 108. For example, the controller 130 may obtain measurements of the discharge pressure using the sensor 142.

The controller 130 may monitor a pressure of the fluid pump 108 (e.g., the intake pressure and/or the discharge pressure), the torque of the motor 132, and the speed of the motor 132. To monitor the pressure of the fluid pump 108, the controller 130 may obtain the measurements of the intake pressure and/or the discharge pressure. In other words, the controller 130 may obtain pressure data indicating the intake pressure and/or the discharge pressure (e.g., the instantaneous intake pressure and/or discharge pressure) for a time period (e.g., the pressure data may be represented by a waveform). The time period may correspond to one cycle of the fluid pump 108 (e.g., where one cycle includes pumping of all cylinders of the fluid pump 108) or multiple cycles of the fluid pump 108. In some implementations, the controller 130 may convert the pressure data into a frequency domain (e.g., by applying a fast Fourier transform (FFT) to the data). Moreover, to monitor the pressure, the controller 130 may process (e.g., analyze) the pressure data (e.g., the original data or the frequency domain data) to determine whether the pressure data is indicative of a leak of the fluid pump 108, as described further below. In some implementations, the pressure data may indicate an instantaneous intake pressure and/or discharge pressure.

To monitor the torque, the controller 130 may obtain the measurements of the torque and/or determine (e.g., estimate) the torque (e.g., based on the current of the motor 132). In other words, the controller 130 may obtain torque data indicating the torque (e.g., the instantaneous torque) or motor current for a time period (e.g., the torque data may be represented by a waveform), in a similar manner as described above. In some implementations, the controller 130 may convert the torque data into a frequency domain, in a similar manner as described above. Moreover, to monitor the torque, the controller 130 may process (e.g., analyze) the torque data (e.g., the original data or the frequency domain data) to determine whether the torque data is indicative of a leak of the fluid pump 108, as described further below. In some implementations, the torque data may indicate an instantaneous torque.

To monitor the speed, the controller 130 may obtain the measurements of the speed and/or determine (e.g., estimate) the speed. In other words, the controller 130 may obtain speed data indicating the speed (e.g., the instantaneous speed) for a time period (e.g., the speed data may be represented by a waveform), in a similar manner as described above. In some implementations, the controller 130 may convert the speed data into a frequency domain, in a similar manner as described above. Moreover, to monitor the speed, the controller 130 may process (e.g., analyze) the speed data (e.g., the original data or the frequency domain data) to determine whether the speed data is indicative of a leak of the fluid pump 108, as described further below. In some implementations, the speed data may indicate an instantaneous speed.

The controller 130 may determine whether the fluid pump 108 is associated with a leak (e.g., of a valve of the fluid pump 108) and/or determine a severity level of the leak based on the torque data, the speed data, and/or the pressure data. For example, when a leak occurs, a cylinder of the fluid pump 108 associated with the leak may produce abnormal torque relative to the remaining cylinders not associated with a leak. As a result, the torque data, the speed data, and the pressure data (e.g., indicating discharge pressure), in connection with a leak, may exhibit differences from the torque data, the speed data, and the pressure data when no leak is present. In some implementations, the controller may determine a failure state of the fluid pump 108, other than a leak, based on the torque data, the speed data, and/or the pressure data. For example, the failure state may be any condition that impacts normal operation of the fluid pump 108, such as a clog or a damaged component of the fluid pump 108, among other examples.

The controller 130 may determine that the fluid pump 108 is associated with a leak and/or determine a severity level of the leak based on the torque data indicating a deviation that satisfies a first threshold, the speed data indicating a deviation that satisfies a second threshold, and/or the pressure data indicating a deviation that satisfies a third threshold. The first threshold, the second threshold, and the third threshold may be the same, or at least one of the first threshold, the second threshold, or the third threshold may be different from each of the other thresholds. The controller 130 may determine that the fluid pump 108 is associated with a leak and/or determine a severity level of the leak based on satisfaction of at least one of the abovementioned conditions or based on satisfaction of all of the abovementioned conditions.

In some examples, the deviation of the torque data may be from an average deviation or a standard deviation of the torque data, the deviation of the speed data may be from an average deviation or a standard deviation of the speed data, and/or the deviation of the pressure data may be from an average deviation or a standard deviation of the pressure data. For example, the torque data, the speed data, and/or the pressure data may indicate multiple pulses for a cycle of the fluid pump 108, and each pulse may correspond to pumping of a respective cylinder of the fluid pump 108. Accordingly, the controller 130 may determine that one or more pulses of the torque data deviate (e.g., are anomalous) relative to the remaining pulses, that one or more pulses of the speed data deviate relative to the remaining pulses, and/or that one or more pulses of the pressure data deviate relative to the remaining pulses, where a deviation of one or more pulses may indicate a leak associated with a cylinder of the fluid pump 108.

Additionally, or alternatively, the deviation of the torque data may refer to a difference between the torque data and reference torque data, the deviation of the speed data may refer to a difference between the speed data and reference speed data, and/or the deviation of the pressure data may refer to a difference between the pressure data and reference pressure data. A difference between torque/speed/pressure data and reference data may be a difference in an area under a curve (AUC), a difference in a minimum value, a difference in a maximum value, and/or a difference in an average value, among other examples. Additionally, or alternatively, the deviation of the torque data may refer to torque oscillations (e.g., in frequency or amplitude) in a time domain and/or the deviation of the speed data may refer to speed oscillations (e.g., in frequency or amplitude) in a time domain.

In some implementations, values for the first threshold, the second threshold, and the third threshold may be first values associated with a first threshold tier, second values (e.g., greater than the first values) associated with a second threshold tier, or third values (e.g., greater than the second values) associated with a third threshold tier, and so forth. Each threshold tier may be associated with a respective severity level for a leak of the fluid pump 108. For example, the first threshold tier may be associated with a first severity level (e.g., indicating a minor leak), the second threshold tier may be associated with a second severity level (e.g., indicating a moderate leak), the third threshold tier may be associated with a third severity level (e.g., indicating a major leak), and so forth. Accordingly, if the first threshold for the torque data is satisfied, the second threshold for the speed data is satisfied, and/or the third threshold for the pressure data is satisfied, then the particular severity level determined by the controller 130 may be the first severity level based on the thresholds being associated with the first threshold tier, may be the second severity level based on the thresholds being associated with the second threshold tier, may be the third severity level based on the thresholds being associated with the third threshold tier, and so forth.

In some implementations, the controller 130 may determine the severity level based on a quantity of the first threshold, the second threshold, and the third threshold that is satisfied. In other words, the particular severity level may be based on whether one of the first threshold, the second threshold, and the third threshold is satisfied (e.g., indicating a minor leak), two of the first threshold, the second threshold, and the third threshold are satisfied (e.g., indicating a moderate leak), or all of the first threshold, the second threshold, and the third threshold are satisfied (e.g., indicating a severe leak).

Additionally or alternatively to determining whether the fluid pump 108 is associated with a leak, the controller 130 may determine whether the fluid pump 108 is associated with cavitation and/or determine a particular severity level of the cavitation based on operating parameters for the fluid pump 108 and/or the motor 132. For example, the controller 130 may determine, with reference to the table described above (an example of which is shown in FIG. 4), a cavitation level associated with the operating parameters. The cavitation level may be an index value, a score, a percentage, or the like, indicating a probability that cavitation is to occur. The operating parameters may include an intake pressure of the fluid pump 108, a discharge pressure of the fluid pump 108, an air percentage of a fracking fluid (that is being pressurized by the fluid pump 108), a proppant percentage of the fracking fluid, and/or a motor speed (e.g., in RPM) of the motor 132.

To determine the cavitation level, the controller 130 may determine (e.g., estimate) a motor speed or pump speed associated with cavitation (e.g., a motor speed or pump speed at which cavitation is likely to occur) for the given operating parameters. The controller 130 may determine the motor speed or pump speed by interpolating (e.g., using linear interpolation) values for the operating parameters to the sets of operating parameter values of the table. The interpolated motor speed or pump speed may be associated with a particular minimum pressure in a chamber of the fluid pump 108 (e.g., according to pressure-speed curves associated with the sets of operating parameter vales of the table), where a pressure of 0 psi or less is associated with cavitation. Thus, the controller 130 may determine the cavitation level based on a difference between the interpolated motor speed or pump speed (at which cavitation is likely to occur for the given operating parameters) and the actual speed of the motor 132 or fluid pump 108, which the controller 130 may monitor as described above.

The controller 130 may monitor (e.g., in real time, periodically, or the like) a cavitation level to determine whether the fluid pump 108 is associated with cavitation and/or a severity level of the cavitation. For example, a higher cavitation level may indicate a greater probability of cavitation and a lower cavitation level may indicate a lesser probability of cavitation. Moreover, the particular severity level of the cavitation may be a first severity level (e.g., indicating minor cavitation) if the cavitation level is below a first threshold, a second severity level (e.g., indicating moderate cavitation) if the cavitation level is between the first threshold and a second threshold, a third severity level (e.g., indicating severe cavitation) if the cavitation level is above the second threshold, and so forth.

The controller 130 may perform at least one operation based on the particular severity level of the leak and/or the particular severity level of the cavitation. An operation may include transmitting (e.g., for presentation on a display, such as a display of the data monitoring system 128) a notification indicating the leak and/or the cavitation. For example, based on the severity level being at least a severity level associated with a minor leak and/or cavitation, the controller 130 may transmit the notification. Thus, the controller 130 may also transmit a notification if the severity level is associated with a moderate leak and/or cavitation or a severe leak and/or cavitation.

An operation may include causing, via the VFD 134, reduction of the speed of the motor 132. For example, based on the severity level being a first severity level (e.g., associated with a moderate leak or moderate cavitation), the controller 130 may cause reduction of the speed of the motor 132 (e.g., reduction to a flow rate of the fluid pump 108) until at least one of the first threshold, the second threshold, or the third threshold is not satisfied by the torque data, the speed data, and/or the pressure data, respectively, and/or until the cavitation level is reduced below a threshold. As another example, based on the severity level being a second severity level (e.g., associated with a severe leak or severe cavitation), the controller 130 may cause reduction of the speed of the motor 132 to a minimum speed that still provides pressurization from the fluid pump 108 (e.g., reduction to a minimum flow rate of the fluid pump 108). In this way, in response to a detected irregularity or failure, the fluid pump 108 may be controlled (e.g., restrained) to reduce or prevent damage to the fluid pump 108. When adjusting the speed of the motor 132, the controller 130 may control a rate of change of the speed of the motor 132 for improved stabilization.

The controller 130 may cause reduction to the speed of the motor 132 via the VFD 134 (e.g., by communicating with a motor control processing unit of the VFD 134). For example, the controller 130 may set a speed setting (e.g., a speed target setting or a speed limit setting), in a control mode for the VFD 134, to a reduced speed value (e.g., a speed value that is lower than a current operating speed of the motor 132). In accordance with the speed setting being set to the reduced speed value, the VFD 134 may control the motor 132 by adjusting the speed of the motor 132 to reduce the speed of the motor 132 to the reduced speed value. In other words, the controller 130 may cause reduction to the speed of the motor 132 by causing the VFD 134 to vary an input frequency and/or an input voltage to the motor 132 to reduce the speed of the motor 132 to the reduced speed value.

In addition to pump-level control of the fluid pump 108, as described herein, the controller 130 (or another controller that controls a fleet of fluid pumps) may also perform system-level control of a plurality of fluid pumps that include the fluid pump 108.

As indicated above, FIG. 2 is provided as an example. Other examples may differ from what is described with regard to FIG. 2.

Figure 3:
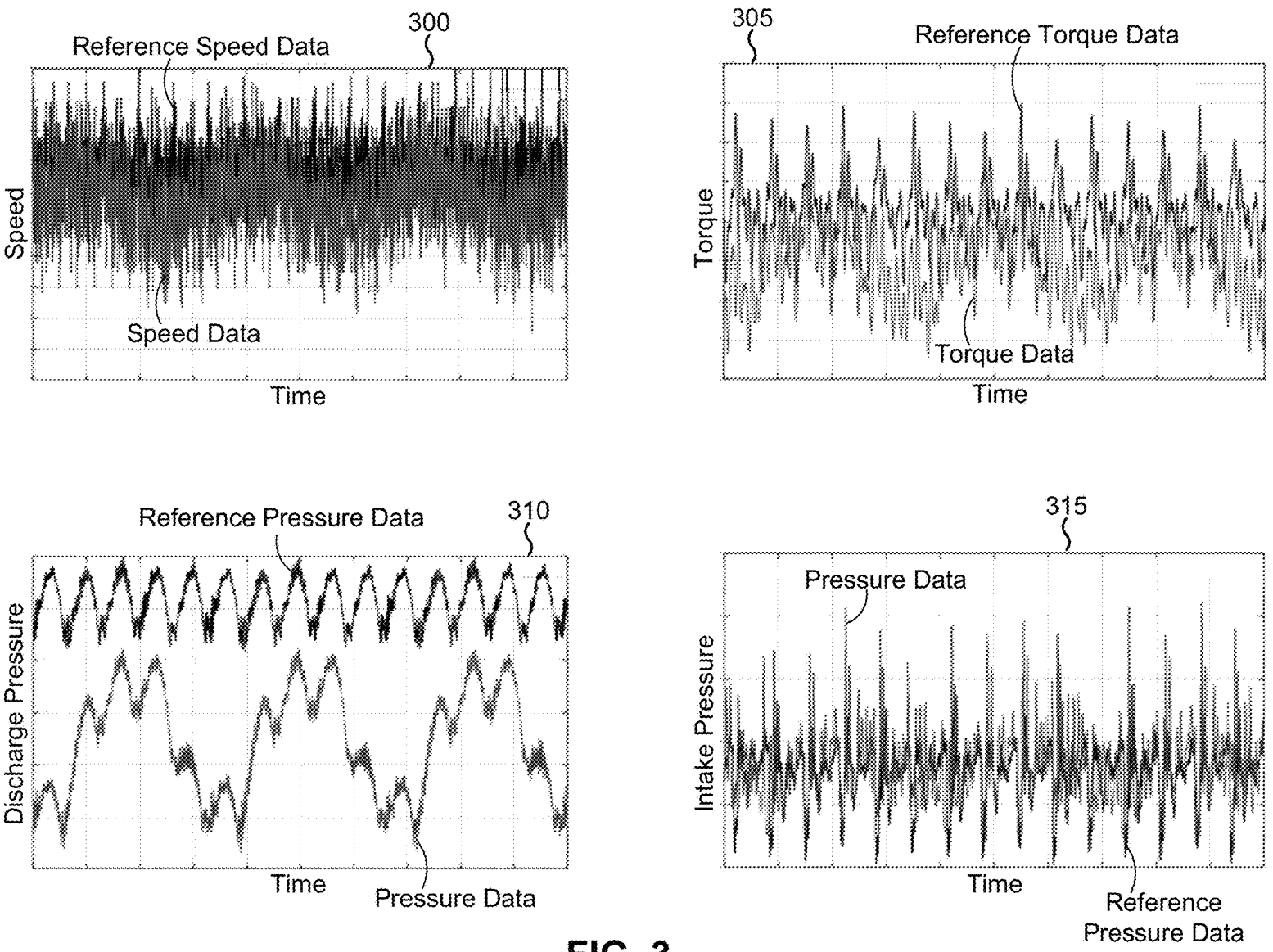
FIG. 3 is a diagram illustrating example plots associated with leak detection in a fluid pump.

FIG. 3 is a diagram illustrating example plots 300, 305, 310, and 315 associated with leak detection in a fluid pump (e.g., fluid pump 108). Plot 300 shows example waveforms indicating speed data (e.g., in connection with a fluid pump associated with a leak) and reference speed data (e.g., in connection with normal operation of the fluid pump), which may correspond to the speed data and reference speed data described in connection with FIG. 2. Plot 305 shows example waveforms indicating torque data (e.g., in connection with a fluid pump associated with a leak) and reference torque data (e.g., in connection with normal operation of the fluid pump), which may correspond to the torque data and reference torque data described in connection with FIG. 2. Plot 310 shows example waveforms indicating discharge pressure data (e.g., in connection with a fluid pump associated with a leak) and reference discharge pressure data (e.g., in connection with normal operation of the fluid pump), which may correspond to the pressure data and reference pressure data described in connection with FIG. 2. Plot 315 shows example waveforms indicating intake pressure data (e.g., in connection with a fluid pump associated with a leak) and reference intake pressure data (e.g., in connection with normal operation of the fluid pump), which may correspond to the pressure data and reference pressure data described in connection with FIG. 2. As illustrated by plots 300, 305, 310, and 315, the waveforms associated with leak states of a fluid pump may have differences from corresponding waveforms associated with normal operation of the fluid pump. Thus, these differences enable detection of a leak, as described herein.

Using plot 310 as an example, the waveforms show distinct pulses representing pumping of respective cylinders of a fluid pump. For example, five consecutive pulses may represent a cycle for a fluid pump having five cylinders. The pulses of the reference pressure data have peaks at approximately the same discharge pressure, thereby indicating normal operation. However, the pulses of the pressure data have peaks that fluctuate in discharge pressure, thereby indicating that one or more of the cylinders of the fluid pump are associated with a leak.

As indicated above, FIG. 3 is provided as an example. Other examples may differ from what is described with regard to FIG. 3.

Figure 4:
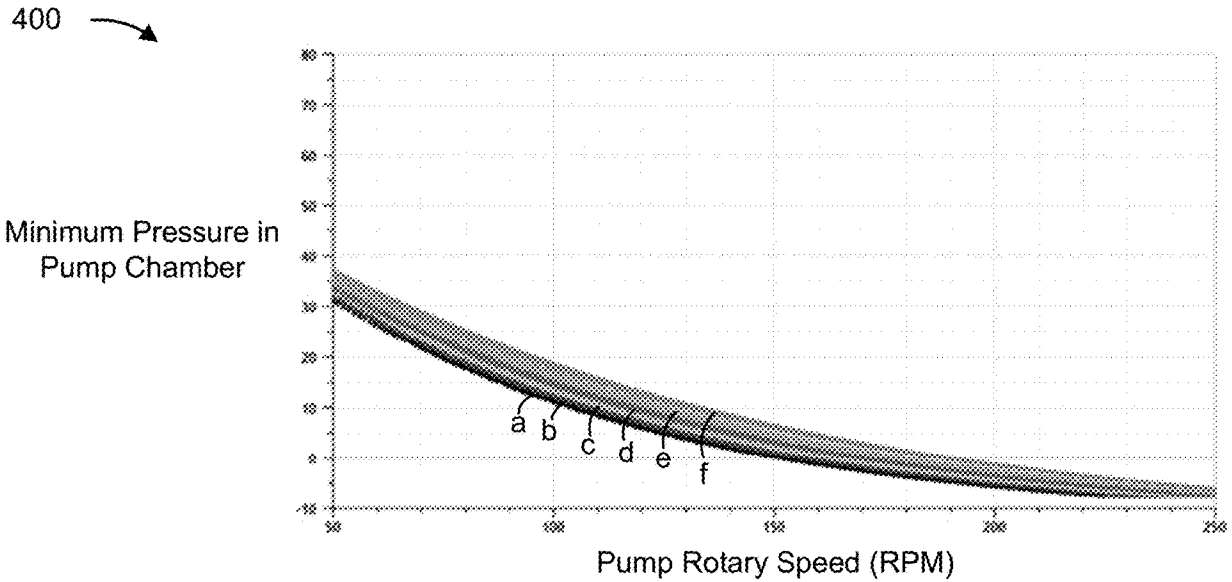
FIG. 4 is a diagram illustrating an example of data associated with cavitation detection in a fluid pump.

FIG. 4 is a diagram illustrating an example 400 of data associated with cavitation detection in a fluid pump (e.g., fluid pump 108). As shown by example 400, a plot of minimum pressure in a pump chamber versus speed may be generated using a pump model, as described herein. Inputs to the pump model may include an intake pressure, a discharge pressure, an air percentage in water of a fracking fluid, and/or a proppant percentage of the fracking fluid. As shown by example 400, a table, which may correspond to the table described in connection with FIG. 2, may be generated based on the data of the plot and an assumption that cavitation may occur when the minimum pressure is 0 psi.

As indicated above, FIG. 4 is provided as an example. Other examples may differ from what is described with regard to FIG. 4.

Figure 5:
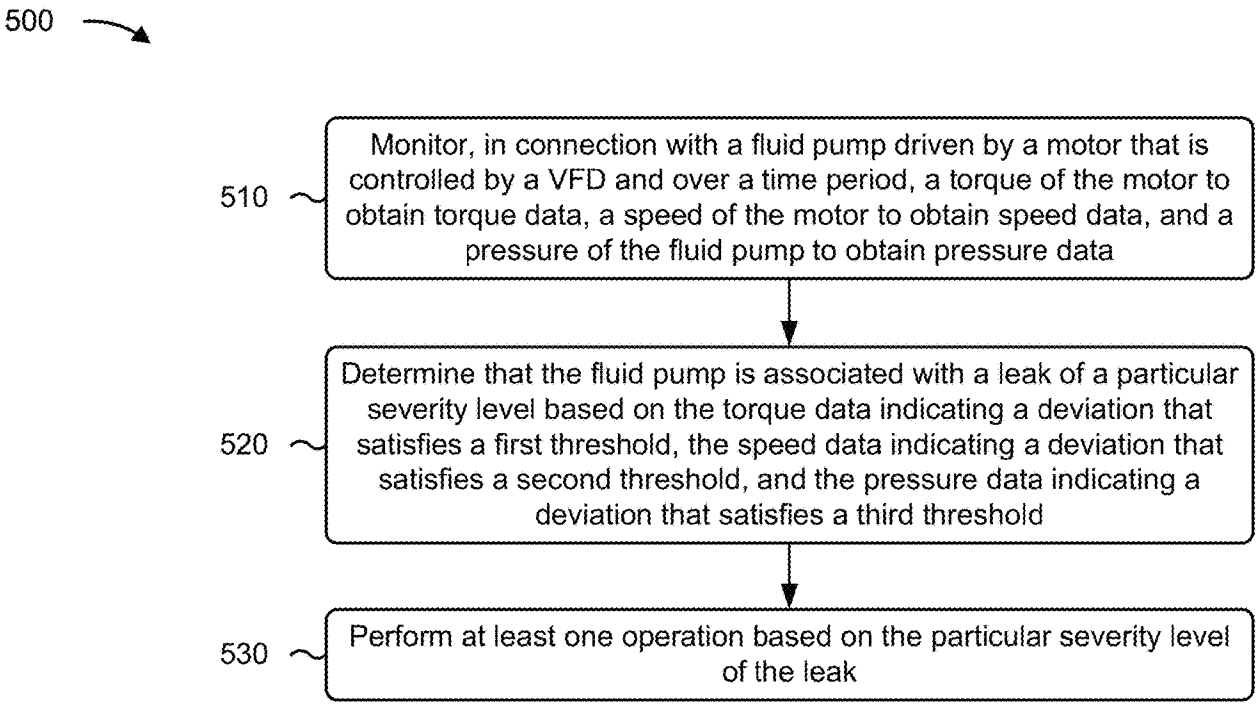
FIG. 5 is a flowchart of an example process associated with fluid pump health protection.

FIG. 5 is a flowchart of an example process 500 associated with fluid pump health protection. One or more process blocks of FIG. 5 may be performed by a controller (e.g., controller 130). Additionally, or alternatively, one or more process blocks of FIG. 5 may be performed by another device or a group of devices separate from or including the controller, such as another device or component that is internal or external to the hydraulic fracturing system 100. Additionally, or alternatively, one or more process blocks of FIG. 5 may be performed by one or more components of a device, such as a processor, a memory, an input component, an output component, and/or communication component.

As shown in FIG. 5, process 500 may include monitoring, in connection with a fluid pump driven by a motor that is controlled by a VFD and over a time period, a torque of the motor to obtain torque data, a speed of the motor to obtain speed data, and a pressure of the fluid pump to obtain pressure data (block 510). For example, the controller may monitor, in connection with a fluid pump driven by a motor that is controlled by a VFD and over a time period, a torque of the motor to obtain torque data, a speed of the motor to obtain speed data, and a pressure of the fluid pump to obtain pressure data, as described above. Process 500 may include determining at least one of the torque or the speed based on a signal of the VFD. The pressure of the fluid pump may include an intake pressure of the fluid pump and a discharge pressure of the fluid pump.

As further shown in FIG. 5, process 500 may include determining that the fluid pump is associated with a leak of a particular severity level based on the torque data indicating a deviation that satisfies a first threshold, the speed data indicating a deviation that satisfies a second threshold, and the pressure data indicating a deviation that satisfies a third threshold (block 520). For example, the controller may determine that the fluid pump is associated with a leak of a particular severity level based on the torque data indicating a deviation that satisfies a first threshold, the speed data indicating a deviation that satisfies a second threshold, and the pressure data indicating a deviation that satisfies a third threshold, as described above.

The particular severity level may be a first severity level based on the first threshold, the second threshold, and the third threshold being associated with a first threshold tier, or a second severity level based on the first threshold, the second threshold, and the third threshold being associated with a second threshold tier. In some implementations, the particular severity level may be based on whether one of the first threshold, the second threshold, and the third threshold is satisfied, two of the first threshold, the second threshold, and the third threshold are satisfied, or all of the first threshold, the second threshold, and the third threshold are satisfied.

The deviation of the torque data may be from an average deviation or a standard deviation of the torque data, the deviation of the speed data may be from an average deviation or a standard deviation of the speed data, and/or the deviation of the pressure data may be from an average deviation or a standard deviation of the pressure data. Additionally, or alternatively, the deviation of the torque data may be a difference between the torque data and reference torque data, the deviation of the speed data may be a difference between the speed data and reference speed data, and/or the deviation of the pressure data may be a difference between the pressure data and reference pressure data.

As further shown in FIG. 5, process 500 may include performing at least one operation based on the particular severity level of the leak (block 530). For example, the controller may perform at least one operation based on the particular severity level of the leak, as described above. The at least one operation may include causing transmission of a notification indicating the leak. The at least one operation may include causing, via the VFD, reduction of the speed of the motor. Causing reduction of the speed of the motor may include causing, based on the particular severity level being a first severity level, reduction of the speed of the motor until at least one of the first threshold, the second threshold, or the third threshold is not satisfied, or causing, based on the particular severity level being a second severity level, reduction of the speed of the motor to a minimum speed that provides pressurization by the fluid pump.

In some implementations, process 500 includes determining, with reference to a table indicating sets of operating parameter values associated with cavitation, a cavitation level associated with operating parameters for the fluid pump and the motor, the cavitation level indicating a probability that cavitation is to occur. Process 500 may further include causing, via the VFD, reduction of the speed of the motor based on the cavitation level. Determining the cavitation level may include determining, for the operating parameters, a motor speed associated with cavitation by interpolating values for the operating parameters to the sets of operating parameter values, and determining the cavitation level based on a difference between the motor speed associated with cavitation and the speed of the motor. The operating parameters may include one or more of an intake pressure of the fluid pump, a discharge pressure of the fluid pump, an air percentage of a fracking fluid, a proppant percentage of the fracking fluid, or a motor speed.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The control system described herein may be used with any hydraulic fracturing system that pressurizes hydraulic fracturing fluid using motor-driven pumps. For example, the control system may be used with a hydraulic fracturing system that pressurizes hydraulic fracturing fluid using a fluid pump that is driven by a motor that is controlled by a VFD. The control system is useful for detecting an irregularity (e.g., a leak, cavitation, or another failure state) of the fluid pump, and for reducing a flow rate of fluid from the pump if the irregularity is detected, thereby preventing excessive wear or damage to the fluid pump that may otherwise occur. In particular, the control system may detect the irregularity by identifying anomalies in data for operating parameters (e.g., speed, torque, intake pressure, and/or discharge pressure) and/or by determining a cavitation level based on a cavitation table. The control system may automatically take corrective action by reducing the flow rate of the pump if the irregularity is detected. Moreover, the control system may reduce the flow rate of the pump by controlling a speed of the motor via the VFD. In this way, the control system may respond to the irregularity with improved speed.

Thus, the control system provides improved monitoring and control of the fluid pump and reduces a likelihood that the fluid pump will operate under abnormal conditions. In particular, utilization of the VFD to reduce motor speed in response to detecting an irregularity enables remedial action to be taken with improved speed and precision. Accordingly, the control system may prevent damage to the fluid pump and/or the hydraulic fracturing system as well as improve a useful life of the fluid pump and/or the hydraulic fracturing system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A system for hydraulic fracturing, comprising:

a fluid pump;

a motor configured to drive the fluid pump;

a variable frequency drive (VFD) configured to control the motor; and a controller configured to:

monitor, over a time period, a torque of the motor to obtain torque data, a speed of the motor to obtain speed data, and a pressure of the fluid pump to obtain pressure data;

determine that the fluid pump is associated with a leak of a particular severity level based on the torque data indicating a deviation that satisfies a first threshold, the speed data indicating a deviation that satisfies a second threshold, and the pressure data indicating a deviation that satisfies a third threshold; and cause, via the VFD, reduction of the speed of the motor based on the particular severity level of the leak, wherein the controller, to cause reduction of the speed of the motor, is configured to:

cause, if the particular severity level is a first severity level, reduction of the speed of the motor until at least one of the first threshold, the second threshold, or the third threshold is not satisfied, and cause, based on the particular severity level being a second severity level, reduction of the speed of the motor by setting a speed target setting to a minimum speed that provides pressurization by the fluid pump.

2. The system of claim 1, wherein the deviation of the torque data is a difference between the torque data and reference torque data, the deviation of the speed data is a difference between the speed data and reference speed data, and the deviation of the pressure data is a difference between the pressure data and reference pressure data.

3. The system of claim 1, wherein the controller is further configured to:

determine, with reference to a table indicating sets of operating parameter values associated with cavitation, a cavitation level associated with operating parameters for the fluid pump and the motor, the cavitation level indicating a probability that cavitation is to occur; and cause, via the VFD, reduction of the speed of the motor based on the cavitation level.

4. The system of claim 3, wherein the controller, to determine the cavitation level, is configured to:

determine, for the operating parameters, a motor speed associated with cavitation by interpolating values for the operating parameters to the sets of operating parameter values; and determine the cavitation level based on a difference between the motor speed associated with cavitation and the speed of the motor.

5. The system of claim 1, wherein the controller is further configured to:

determine at least one of the torque or the speed based on a signal of the VFD.

6. The system of claim 1, wherein the pressure of the fluid pump includes an intake pressure of the fluid pump and a discharge pressure of the fluid pump.

7. A method, comprising:

monitoring, by a controller in connection with a fluid pump driven by a motor that is controlled by a variable frequency drive (VFD) and over a time period, a torque of the motor to obtain torque data, a speed of the motor to obtain speed data, and a pressure of the fluid pump to obtain pressure data;

determining, by the controller, that the fluid pump is associated with a leak of a particular severity level, corresponding to a quantity of thresholds satisfied, based on whether the torque data indicates a deviation that satisfies a first threshold, the speed data indicates a deviation that satisfies a second threshold, and the pressure data indicates a deviation that satisfies a third threshold; and causing, by the controller and based on the particular severity level of the leak, reduction of the speed of the motor by setting a speed target setting to a minimum speed that provides pressurization by the fluid pump.

8. The method of claim 7, wherein the deviation of the torque data is from an average deviation or a standard deviation of the torque data, wherein the deviation of the speed data is from an average deviation or a standard deviation of the speed data, and wherein the deviation of the pressure data is from an average deviation or a standard deviation of the pressure data.

9. The method of claim 7, further comprising:

causing transmission of a notification indicating the leak.

10. The method of claim 7, wherein causing the reduction of the speed of the motor includes causing, via the VFD, the reduction of the speed of the motor.

11. The method of claim 2, further comprising:

causing, based on a different severity level that indicates less severity than the particular severity level, reduction of the speed of the motor until at least one of the first threshold, the second threshold, or the third threshold is not satisfied.

12. The method of claim 7, further comprising:

determining, with reference to a table indicating sets of operating parameter values associated with cavitation, a cavitation level associated with operating parameters for the fluid pump and the motor, the cavitation level indicating a probability that cavitation is to occur.

13. The method of claim 7, wherein the particular severity level is a first type of severity level when the quantity of thresholds satisfied indicates that all of the first threshold, the second threshold, and the third threshold are satisfied, and wherein the particular severity level is a second type of severity level or a third type of severity level when the quantity of thresholds satisfied indicates that less than all of the first threshold, the second threshold, and the third threshold are satisfied.

14. A controller, comprising:

one or more memories; and one or more processors, communicatively coupled to the one or more memories, configured to:

monitor, in connection with a fluid pump driven by a motor that is controlled by a variable frequency drive (VFD) and over a time period, at least one of a torque of the motor to obtain torque data, a speed of the motor to obtain speed data, or a pressure of the fluid pump to obtain pressure data;

determine whether the fluid pump is associated with a leak of a particular severity level based on at least one of the torque data indicating a deviation that satisfies a first threshold, the speed data indicating a deviation that satisfies a second threshold, or the pressure data indicating a deviation that satisfies a third threshold;

determine, with reference to a table indicating sets of operating parameter values associated with cavitation, a cavitation level associated with operating parameters for the fluid pump and the motor, the operating parameters including:

a proppant percentage of a fracking fluid, and one or more other operating parameters, the table indicating that at a first value for a proppant percentage of the fracking fluid and one or more other values for the one or more other operating parameters cavitation occurs at a first motor speed, the table indicating that at a second, different value for the proppant percentage of the fracking fluid and the same one or more other values for the one or more other operating parameters cavitation occurs at a second, different motor speed, the sets of operating parameter values including:

a first set that includes the first value and the one or more other values, and a second set that includes the second, different value and the same one or more other values, and the cavitation level indicating a probability that cavitation is to occur; and cause, via the VFD, reduction of the speed of the motor based on at least one of the particular severity level of the leak or the cavitation level.

15. The controller of claim 14, wherein the one or more processors, to determine the cavitation level, are configured to:

determine, for the operating parameters, a motor speed associated with cavitation by interpolating values for the operating parameters to the sets of operating parameter values; and determine the cavitation level based on a difference between the motor speed associated with cavitation and the speed of the motor.

16. The controller of claim 14, wherein the one or more operating parameters include one or more of an intake pressure of the fluid pump, a discharge pressure of the fluid pump, or an air percentage of the fracking fluid.

17. The controller of claim 14, wherein the one or more processors, to determine whether the fluid pump is associated with the leak of the particular severity level, are configured to:

determine whether the fluid pump is associated with the leak of the particular severity level based on all of the torque data indicating the deviation that satisfies the first threshold, the speed data indicating the deviation that satisfies the second threshold, and the pressure data indicating the deviation that satisfies the third threshold.

18. The controller of claim 14, wherein the particular severity level is based on whether one of the first threshold, the second threshold, and the third threshold is satisfied, two of the first threshold, the second threshold, and the third threshold are satisfied, or all of the first threshold, the second threshold, and the third threshold are satisfied.

19. The controller of claim 14, wherein the one or more other operating parameters include:

an intake pressure of the fluid pump, a discharge pressure of the fluid pump, and an air percentage of the fracking fluid, and wherein the one or more other values, for the one or more other operating parameters, include:

a first value for the intake pressure of the fluid pump, a second value for the discharge pressure of the fluid pump, a third value for the air percentage of the fracking fluid.

* * * * *